US005688103A

United States Patent [19]

Tsuji et al.

[11] Patent Number: 5,688,103

[45] Date of Patent: Nov. 18, 1997

[54] VIBRATION REDUCER FOR TRANSFER APPARATUSES

[75] Inventors: Hideki Tsuji, Yamato; Hiroyuki Ito, Yokohama; Shinji Mitsuta, Hiratsuka; Kenji Nishida, Matto; Naoyuki Kanayama, Kaga, all of Japan

[73] Assignee: Komatsu Ltd., Tokyo, Japan

[21] Appl. No.: 522,378

[22] PCT Filed: Mar. 24, 1994

[86] PCT No.: PCT/JP94/00467

§ 371 Date: Sep. 21, 1995

§ 102(e) Date: Sep. 21, 1995

[87] PCT Pub. No.: WO94/21403

PCT Pub. Date: Sep. 29, 1994

[30] Foreign Application Priority Data

Mar. 24, 1993 [JP] Japan ..... 5-089366

[51] Int. Cl.[6] ..... B65G 43/00

[52] U.S. Cl. ..... 414/752; 198/464.1; 198/464.4; 198/468.2; 198/468.4; 198/751

[58] Field of Search ..... 198/464.1, 464.4, 198/468.2, 468.4, 751; 414/750–752

[56] References Cited

U.S. PATENT DOCUMENTS 4,654,569 3/1987 Mizumoto et al. ..... 414/750
4,995,505 2/1991 Takahashi et al. ..... 198/468.4
5,231,860 8/1993 Tsuruta et al. ..... 72/21

FOREIGN PATENT DOCUMENTS 4344002 6/1995 Germany .
3-47639 2/1991 Japan .
6-269875 9/1994 Japan .

*Primary Examiner*—Joseph E. Valenza
*Attorney, Agent, or Firm*—Sidley & Austin

[57] ABSTRACT

This invention aims at reducing the vibration occurring during a motion of a vacuum transfer apparatus in a transfer press, and preventing the misfeeding of a workpiece. To achieve this object, accelerometers (30, 32) are set on one of lift bars (1) and a crossbar (21) laid laterally on a crossbar carrier (20) on each of right and left lift bars (1), and they are connected to a controller (34) through integrators (31, 33). An actuator (10) is provided on a drive rod (8) via which a lift lever (7) and a lift box (3) are connected together, and a hydraulic servo-valve (11) and the controller (34) are connected to each other through a servo-amplifier (35). The controller (34) is adapted to determine, moment by moment, a control input into the actuator (10) on the basis of measurement amounts of vibration from the accelerometers (30, 32) and the dynamic characteristics of the crossbar (21), and to operate the actuator (10) every time the control input is determined, whereby the vibration of a transfer apparatus is reduced.

20 Claims, 14 Drawing Sheets

(PRESENT EMBODIMENT)

(TRAPECLOID PATH)

(PRESENT EMBODIMENT)

(TRAPECLOID PATH)

(PRESENT EMBODIMENT)

(PRESENT EMBODIMENT)

(TRAPECLOID PATH )

VIBRATION REDUCER FOR TRANSFER APPARATUSES

TECHNICAL FIELD

The present invention relates to a vibration reducer for an apparatus of transferring a workpiece to be press molded or a press molded workpiece.

BACKGROUND ART

A conventional transfer press is equipped with a transfer feeder for loading and unloading a workpiece to and from a processing station and for transferring a workpiece under process (hereinafter referred to as a workpiece) between processing stations. Particularly, for transferring a large workpiece, like a panel, and a workpiece of a low rigidity, a transfer feeder employing a vacuum transfer system is used.

In the transfer feeder employing a vacuum transfer system, a plurality of crossbar carriers, which are moved by a feeding apparatus in the direction of feeding a workpiece, are provided on lift bars which are arranged parallel to the feeding direction and which are moved in the vertical direction by a lifting apparatus. Vacuum cups, for vacuum chucking a workpiece, are provided on a crossbar laid laterally on opposed crossbar carriers.

The transfer feeder is adapted to repeat a series of the following operational motions: the crossbar is lowered by the lifting apparatus so that the vacuum cups vacuum chuck a workpiece, then the crossbar is raised by the lifting apparatus and moved in the feeding direction by the feeding apparatus, the crossbar is lowered again to unload the workpiece onto the next station, and then the crossbar returns to its original position. In the transfer feeder, if the crossbar vibrates in the vertical direction or in the feeding direction during operation, the vacuum cups provided on the crossbar might fail to vacuum chuck a workpiece, with a resultant occurrence of the misfeeding of a workpiece.

To prevent this problem, the following measures are proposed:

(1) The crossbar is formed of carbon fiber reinforced plastic to reduce weight and increase rigidity, whereby the vibration of the crossbar is reduced.

(2) The lift bar is supported at multiple points to shorten a support span, thereby to increase the characteristic frequency of the lift bar, whereby the vibration of the lift bar is reduced, and thus the vibration of the crossbar is reduced.

(3) The lift bar is provided with a vibration absorber to reduce the vibration of the lift bar, whereby the vibration of the crossbar is reduced.

However, the above measures involve the following problems:

(1) The crossbar formed of carbon fiber reinforced plastic is very expensive, hard to process, and inferior to a steel crossbar in durability. Furthermore, the overall vibration level is reduced, but the residual vibration still exists after an operational motion is halted.

(2) If the lift bar is supported at multiple points, the support elements should retreat somewhere else when molds are to be changed, and thus the work efficiency deteriorates. Also, although the overall vibration level is reduced, the residual vibration still exists after an operational motion is halted.

(3) Providing the lift bar with a vibration absorber has an advantage of a lower apparatus cost, but requires tuning the vibration absorber according to the apparatus concerned. Also, although an effect of reducing the residual vibration can be expected from this measure, an effect of reducing a peak of the vibration excited by an operational motion acceleration cannot be much expected.

SUMMARY OF THE INVENTION

The present invention has been accomplished in view of the above-mentioned problems. An object of the present invention is to provide a vibration reducer for a transfer apparatus, in a transfer press or the like, capable of effectively and easily reducing the vibration during an operational motion as well as the residual vibration after halting the operational motion.

According to the present invention, in a transfer apparatus provided with a mechanism for holding a press molded workpiece, a support member for supporting the workpiece holding mechanism, a structural unit for movably positioning the support member, and a drive unit to move the support member, a controllable actuator is provided in an operational motion transmission path extending from the drive unit to the support member which supports the workpiece holding mechanism, sensing means is provided on at least one of the workpiece holding mechanism, the support member which supports the workpiece holding mechanism, the structural unit for movably positioning the support member, and the drive unit to move the support member, and a controller is provided which is adapted to determine, moment by moment, a control input to the actuator on the basis of measurements from the sensing means and previously obtained dynamic characteristics of the support member which supports the workpiece holding mechanism, and to operate the actuator every time the control input is determined. The controller can be adapted to determine, moment by moment, a control input to the actuator on the basis of measurements from the sensing means and previously obtained dynamic characteristics of the support member which supports the workpiece holding mechanism and dynamic characteristics of the actuator.

The controller can be adapted to determine a control input to the actuator on the basis of measurements from the sensing means and at least one of previously obtained dynamic characteristics of the support member which supports the workpiece holding mechanism and of previously obtained dynamic characteristics of the actuator, and to operate the actuator at arbitrary timing.

Furthermore, the controllable actuator is provided in the operational motion transmission path extending from the drive unit to the support member which supports the workpiece holding mechanism, and the controller which is provided is adapted to compute a damping motion for preventing the vibration from occurring on the basis of previously obtained dynamic characteristics of the support member which supports the workpiece holding mechanism, and dynamic characteristics of the actuator, and operate the actuator at arbitrary timing with the difference, between a motion made by the drive unit and the thus computed damping motion, taken as a control input to the actuator.

In the construction thus arranged, the actuator is provided in the operational motion transmission path extending from the drive unit to the support member which supports the workpiece holding mechanism, and the controller which is provided is adapted to compute a control input to the actuator and issue a control signal to the actuator so as to reduce the vibration in response to a detection signal indicative of the vibration, in the vertical direction, by the lift bar or by the supporting member, i.e., the crossbar, whereby the actuator operates so as to reduce the vibration in the vertical direction of the lift bar or the crossbar in accordance with the control signal.

Also, a controller is provided which is adapted to compute a control input to the actuator and issue a control signal to the actuator so as to reduce the vibration in response to a detection signal indicative of the vibration of the supporting member, i.e., the crossbar, in the feeding direction, whereby the actuator operates so as to reduce the vibration of the crossbar in the feeding direction in accordance with the control signal.

Furthermore, a controller is provided which is adapted to compute a damping motion against the occurrence of the vibration on the basis of previously obtained dynamic characteristics of the support member, which supports the workpiece holding mechanism, and dynamic characteristics of the actuator, and issue a control signal to the actuator, whereby the actuator particularly operates so as to reduce the residual vibration of the supporting member, i.e., the crossbar.

BEST MODE FOR CARRYING OUT THE INVENTION

A transfer apparatus equipped with a vibration reducer to reduce the vibration in a vertical direction, according to a first embodiment of the present invention, will now be described in detail with reference to FIGS. 1 and 2.

Figure 1:
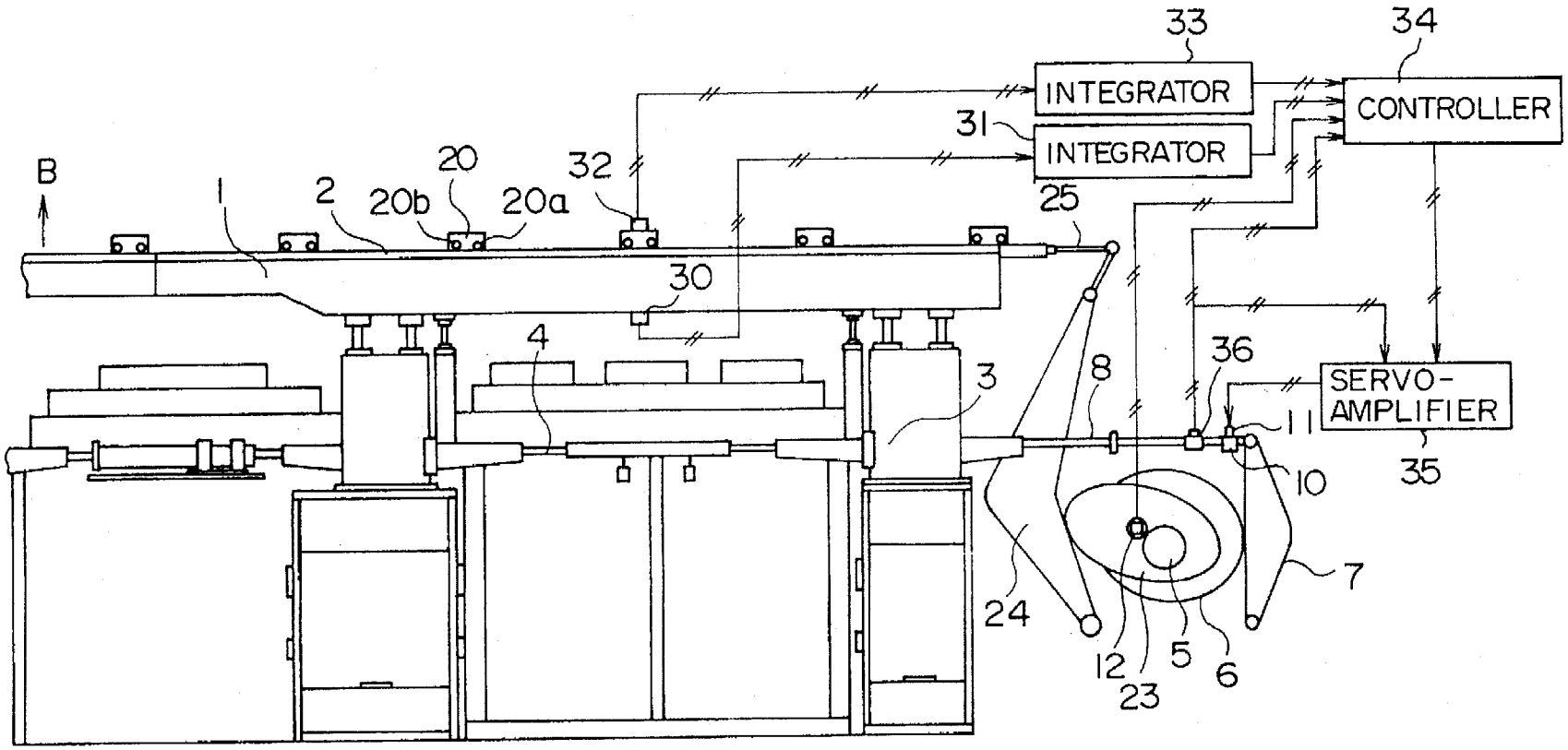
FIG. 1 is a side view of a transfer apparatus equipped with a vibration reducer for reducing the vibration in the vertical direction according to a first embodiment of the present invention.
Figure 2:
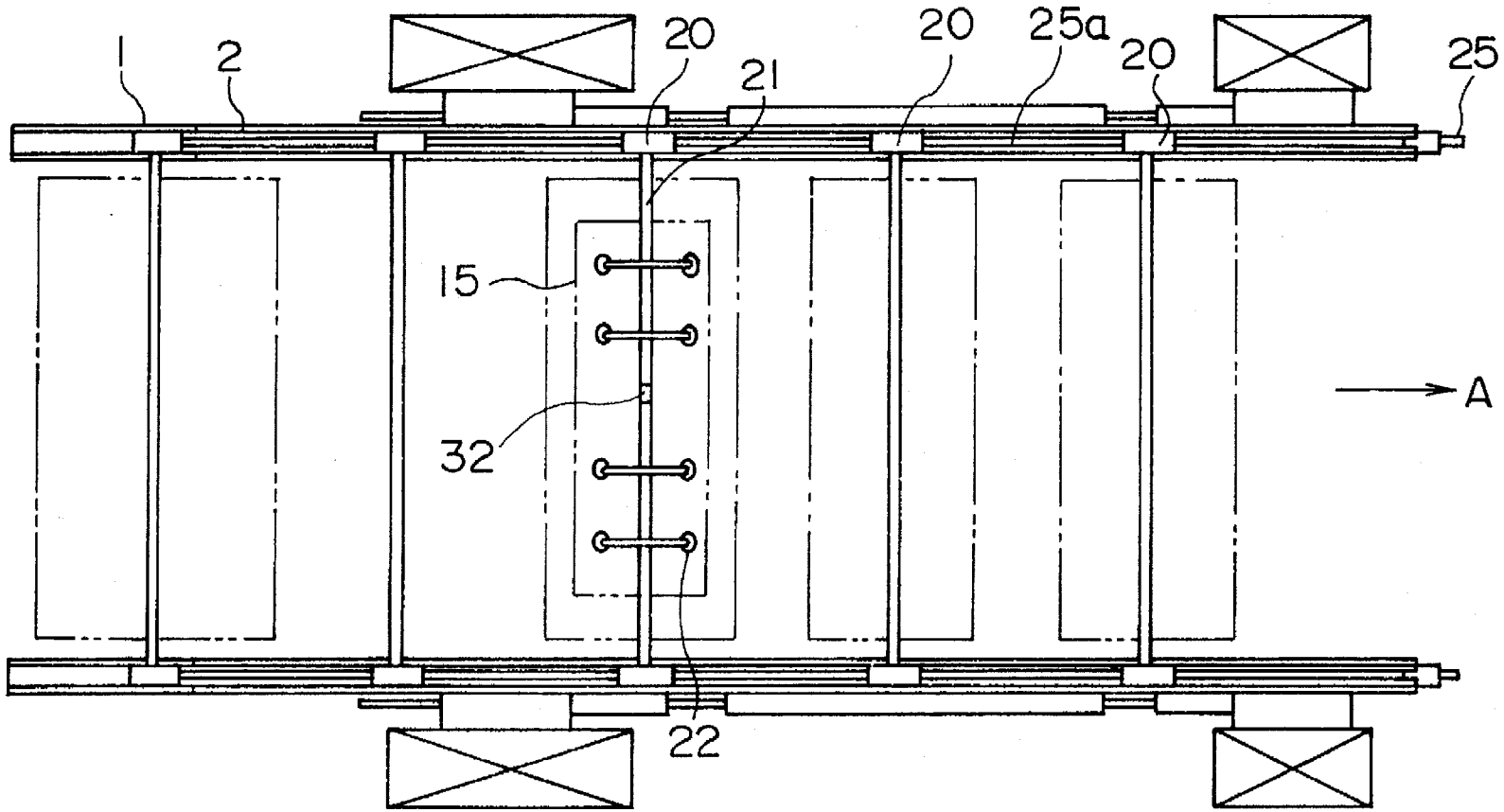
FIG. 2 is a plan view of the transfer apparatus of FIG. 1.

In FIG. 1, reference numeral i denotes a lift bar; 2, a guide rail; 3, a lift box containing a lifter gearing, not shown; 4, an equalizer rod for connecting lift boxes in series; 5, a cam shaft driven by a power source, not shown; 6, a lift cam; 7, a lift lever driven by the lift cam 6; and 8, a drive rod to connect the lift lever 7 and the lift box 3, thereby to compose lifter means. A hydraulic actuator (hereinafter referred to as actuator) 10, fitted with a hydraulic servo-valve 11, is provided on the drive rod 8, linked with the lift lever 7 to compose a drive unit. The arrow B in FIG. 1 indicates the lifting direction of the lift bars 1.

A plurality of crossbar carriers 20 are mounted on the guide rails 2, each crossbar carrier 20 being a structural unit which holds the guide rail 2 by rolling elements 20*a*, 20*b*. The crossbar carriers 20 are connected to each other by connecting rods 25*a*. Reference numeral 23 denotes a feed cam, and numeral 24 denotes a feed lever, which is linked through a link 25 with the crossbar carriers 20 connected in series in the feeding direction. As shown in FIG. 2, a crossbar 21 is laid laterally on the opposed crossbar carriers 20, 20, which crossbar 21 supports a plurality of vacuum cups 22 used for vacuum chucking a workpiece. Arrow A indicates the feeding direction.

An accelerometer 30 is provided on the lift bar 1, as sensing means for measuring the vibration in the vertical direction, and is connected to a controller 34 through an integrator 31. An accelerometer 32 is also provided, as needed, on the crossbar 21 and connected to the controller 34 through an integrator 33. The controller 34 is connected to an encoder 12, provided on the cam shaft 5, and to a servo-amplifier 35, which, in turn, is connected to the hydraulic servo-valve 11. A displacement gauge 36, to sense a stroke of the actuator 10, is provided on the drive rod 8, located between the actuator 10 and the lift box 3. The displacement gauge 36 is connected to the controller 34 and the servo-amplifier 35.

An operation of reducing the vibration in the vertical direction will now be described. As the cam shaft 5 rotates, the lift cam 6 causes the lift lever 7 to oscillate, and consequently the lift box 3 operates to move the lift bars 1 in the vertical direction. At the same time, the feed cam 23 causes the feed lever 24 to oscillate to move the crossbar carriers 20 in the feeding direction thereby to mechanically generate one operational motion. The vacuum cups 22 vacuum chuck the workpiece 15, as shown in FIG. 2, to transfer it to the next station. During the operational motion, vibration occurs in the vertical direction. The vibration of the lift bar 1 and the vibration of the crossbar 21 are measured by respective accelerometers 30, 32 and then undergo the second order integration at the integrators 31, 33, respectively. The result of each integration is inputted into the controller 34 as a displacement. A quantity of control of the actuator 10 is also inputted into the controller 34 through the displacement gauge 36. Based on these measurements, a quantity of control of the actuator 10 is computed at the controller 34, and the result is outputted to the servo-amplifier 35. In response to a command value from the servo-amplifier 35, the hydraulic servo-valve 11 operates to operate the actuator 10 accordingly, thereby reducing the vibration of the transfer apparatus. Also, data from the encoder 12, provided on the cam shaft 5, is inputted into the controller 34 as needed (for example, to establish timing in effecting control in an open loop).

Next, a system will be described in which a displacement of the actuator 10 and a displacement obtained by integrating an acceleration of the lift bar 1 are used as quantities of state. The dynamic characteristics of the actuator 10 and the lift bar 1 are examined in advance in order to represent each of the actuator 10 and the lift bar 1 by a single-degree-of-freedom model, and the LQ control theory is applied to each single-degree-of-freedom model to obtain a feedback gain for each of the actuator 10 and the lift bar 1. The thus obtained feedback gains are previously stored in the controller 34. A displacement of the actuator 10 and a displacement obtained by integrating an acceleration of the lift bar 1 are inputted to the controller 34 at predetermined timing of sampling. The input displacement data is interpolated to make a velocity. Based on the thus inputted and computed data, a quantity of control is obtained. In order to prevent a drift of data derived from integration, a displacement, obtained by integrating an acceleration of the lift bar 1, is subjected to a bypass filter, and hence a lag in the phase of data results. Thus, the data is corrected for the lag in the controller 34 according to previously obtained characteristics of the bypass filter.

Next, a system will be described in which a displacement obtained by integrating an acceleration of each of the crossbar 21 and the lift bar i and a displacement of the hydraulic actuator 10 are used as quantities of state.

Figure 3:
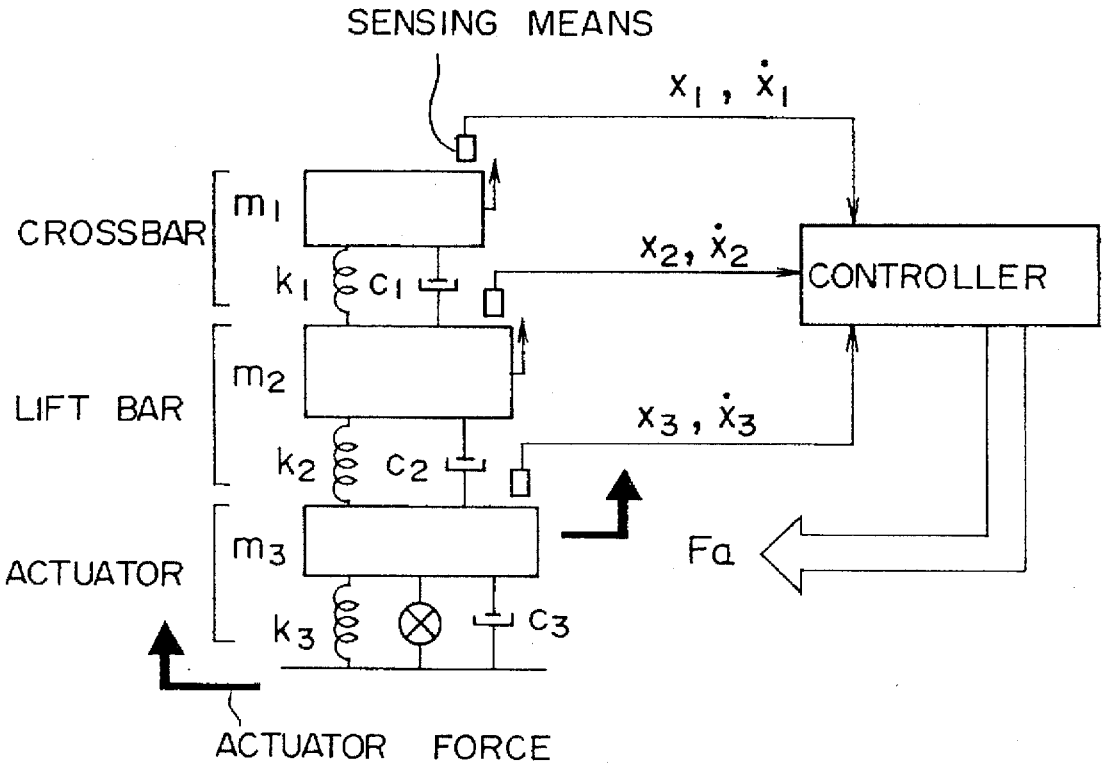
FIG. 3 is a diagram illustrating a mass-spring-damper model of the structure of the vibration reducer according to the first embodiment.

As shown in FIG. 3, each controlled system is represented by a mass (m)-spring (k)-damper (c) model. In this case, the transfer apparatus is represented by a three-degree-of-freedom model composed of the crossbar 21 ($m_1$, $k_1$, $c_1$), the lift bar 1 ($m_2$, $k_2$, $c_2$), and the actuator 10 ($m_3$, $k_3$, $c_3$). Also, an equivalent mass, an equivalent rigidity, and an equivalent attenuation for each degree of freedom are obtained by a transfer function obtained by impact excitation or the like or by step response.

Equations of motion are set up for the model of FIG. 3 as follows:

$$m_1x_{a1}+c_1(x_{b1}-x_{b2})+k_1(x_1-x_2)=0 \quad (1)$$

$$m_2x_{a2}+c_1(x_{b2}-x_{b1})+c_2(x_{b2}-x_{b3})+k_1(x_2-x_1)+k_2(x_2-x_3)=0 \quad (2)$$

$$m_3x_{a3}+c_2(x_{b3}-x_{b2})+c_3(x_{b3}-x_{b0})+k_2(x_3-x_2)+k_3(x_3-x_0)=F_a \quad (3)$$

where $x_a$ is acceleration; $x_b$, velocity; $F_a$, a controlling force of the hydraulic actuator 10; and $x_O$, a motion displacement generated by the cams 6, 23.

With a relative displacement for each degree of freedom taken as:

$$x_r=x_1-x_2 \quad (4)$$

$$x_s=x_2-x_3 \quad (5)$$

Equations (1), (2), and (3) are rewritten as follows:

$$x_{a1}=-(c_1/m_1)x_{br}-(k_1/m_1)x_r \quad (6)$$

$$x_{a2}=(c_1/m_2)x_{br}-(c_2m_2)x_{bs}+(k_1/m_2)x_r-(k_2/m_2)x_s \quad (7)$$

$$x_{a3}=(c_2/m_3)x_{bs}-(c_3/m_3)x_{b3}+(k_2/m_3)X_s-(k_3/m_3)x_3-F_a/m_3+(c_3x_{b0}+k_3x_0)/m_3 \quad (8)$$

In this case, $(c_3X_{b0}+k_3x_0)/m_3$ can be regarded as a disturbance component to a structure system. Hence, a problem concerned can be considered as a regulator problem to stabilize the structure system against this disturbance component. The state variable x and the controlling force $F_a$ are defined as follows:

$$x=\{x_{br}, x_{bs}, x_{b3}, x_r, x_s, x_3\}^T \quad (9)$$

$$F_a=K_f\mu \quad (10)$$

where $K_f$ is a force conversion coefficient.

Using the state variable X and the controlling force $F_a$, the relations expressed by Equations (1) and (2) are represented by the following state equation:

$$X_b=AX+bu=\{x_{ar}, x_{as}, x_{a3}, x_{br}, x_{bs}, x_{b3}\}^T \quad (11)$$

where coefficient matrices A and b are expressed as follows:

$$A=\begin{bmatrix} -\left(\frac{c_1}{m_1}+\frac{c_1}{m_2}\right) & \frac{c_2}{m_2} & 0 & -\left(\frac{k_1}{m_1}+\frac{k_1}{m_2}\right) & \frac{k_2}{m_2} & 0 \\ \frac{c_1}{m_2} & -\left(\frac{c_2}{m_2}+\frac{c_2}{m_3}\right) & \frac{c_3}{m_3} & \frac{k_1}{m_2} & -\left(\frac{k_2}{m_2}+\frac{k_2}{m_2}\right) & \frac{k_3}{m_3} \\ 0 & \frac{c_2}{m_3} & -\frac{c_3}{m_3} & 0 & \frac{k_2}{m_3} & -\frac{k_3}{m_3} \\ 1 & 0 & 0 & 0 & 0 & 0 \\ 0 & 1 & 0 & 0 & 0 & 0 \\ 0 & 0 & 1 & 0 & 0 & 0 \end{bmatrix} \quad (12)$$

$$b=\left\{0\ -\frac{K_f}{m_3}\ \frac{K_f}{m_3}\ 000\right\}^T \quad (13)$$

Here, a state feedback as expressed below is given.

$$u=-KX \quad (14)$$

A state feedback gain vector is expressed by $$K=\{_1, K_2, K_3, K_4, K_5, K_6) \quad (15)$$

A control system is designed by the optimal control theory. In this case, design parameters are the weight coefficient Q and the weight coefficient r to be given to the following quadratic evaluation function J.

A value of J is calculated by $$J=\int_{o}^{\infty}(X^TQX+u^2r)dt \tag{16}$$

According to the optimal control theory, a quantity of control, u, to minimize the value of the evaluation function is formulated as follows:

$$u=-r^{-1}b^TPX=-KX \tag{17}$$

where P is a solution of the following Riccati's equation:

$$PA+A^TP-Pbr^{-1}b^TP+Q=0 \tag{18}$$

By solving this Riccati's equation, the state feedback gain K is obtained. Thus, the quantity of control, u, is obtained from Eq. (14), and the controlling force $F_a$ is obtained from Eq. (10).

Figure 4:
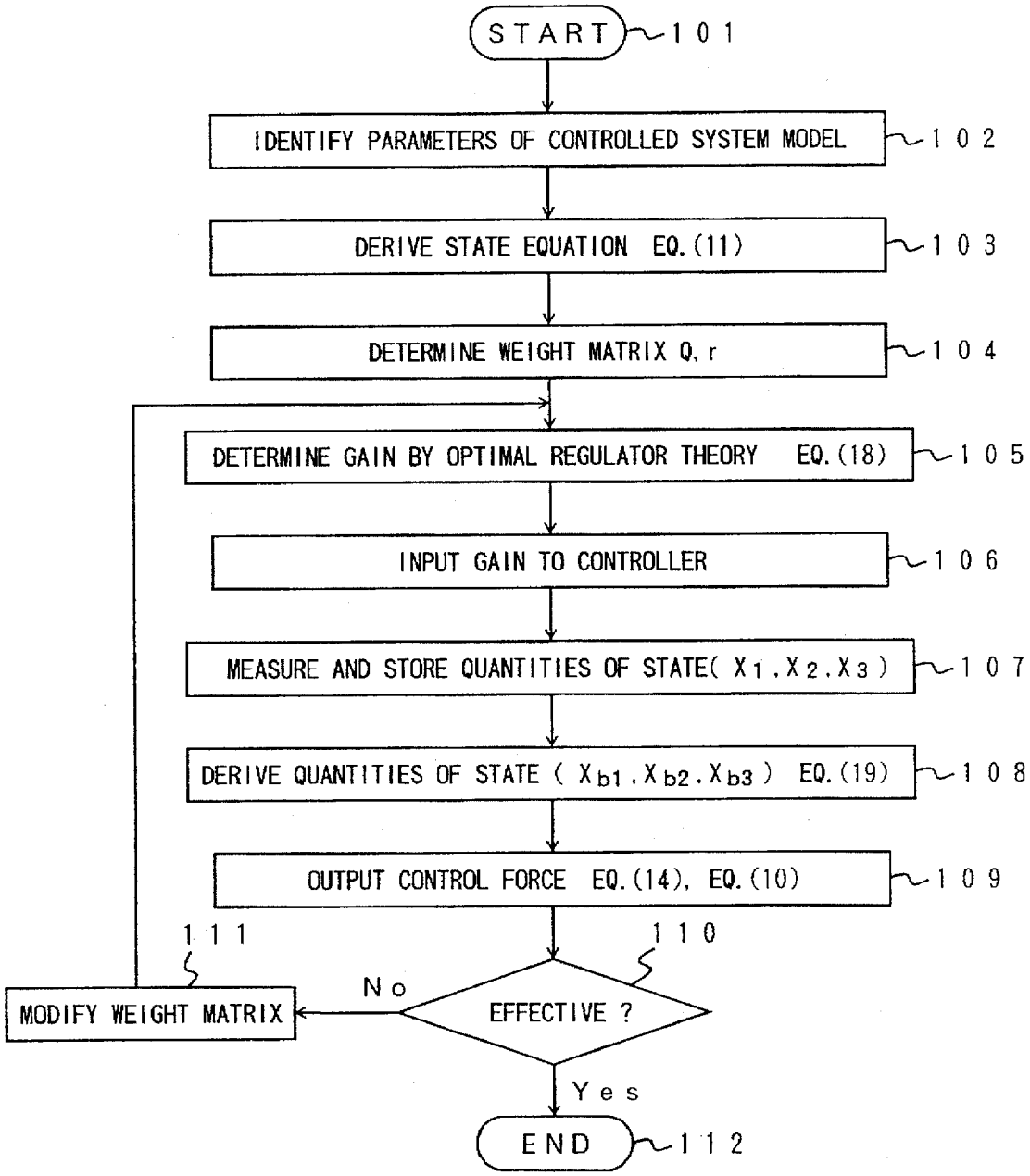
FIG. 4 is a flow chart illustrating a feedback control method.

Next, how to obtain quantities of state will be described. For the crossbar 21 and the lift bar 1, a displacement obtained by second-order integrating a sensed acceleration is used as a quantity of state. For the hydraulic actuator 10, a sensed displacement is used as a quantity of state. The velocity $X_b$ for each degree of freedom is obtained by $$x_b(t)=\{x(t)-x(t-\Delta t)\}/\Delta t \tag{19}$$

where x(t) is a displacement at time t, and Δt is a sampling time for measuring a displacement. The aforesaid computation control is summarized in FIG. 4 as a flow chart composed of step 101 through step 112.

According to the present embodiment, a control theory used in the controller 34 is a feedback control method which determines a gain by the LQ control theory, wherein a vibratory displacement of each of the crossbar 21 and the lift bar 1 and a displacement of the actuator 10 are taken as reference signals, and wherein a mean square of vibratory displacements of each of the crossbar 21 and the lift bar 1 at white noise input is used as an evaluation function.

In addition to the above-mentioned control method, the following control methods can also be used:

(1) A feedforward control method which determines a gain by an acceleration-displacement conversion method, wherein an operational motion acceleration is taken as a reference signal, and wherein a quasi-static displacement component derived from a change in an operational motion acceleration is used as an evaluation function.

(2) An LMS adaptive control method which determines a gain by the LMS (Least Mean Square) algorithm, wherein an operational motion acceleration and a displacement of the crossbar 21 are taken as reference signals, and wherein a mean square of vibratory displacements of the crossbar 21 at an operational motion input is used as an evaluation function.

(3) A preview learning control method which determines a gain by a preview learning algorithm, wherein a displacement of the crossbar 21 is taken as a reference signal, and wherein a mean square of vibratory displacements of the crossbar 21 at an operational motion input is used as an evaluation function.

(4) A control method which uses the neutral network theory, wherein a displacement of each of the crossbar 21 and the lift bar 1 is taken as a reference signal, and wherein a mean square of vibratory displacements of the crossbar 21 is used as an evaluation function.

These control methods can be used concurrently, or they can be selectively used, for example, control method A is used at a certain time and control method B is used at remaining time (for example, the LMS adaptive control method is applied when an operational motion is given, and the feedback control is carried out when an operational motion is not given).

Next, a transfer apparatus equipped with a vibration reducer to reduce the vibration in the feeding direction of a cantilever 55, attached to the crossbar 21 at the center thereof, and the crossbar 21, according to a second embodiment of the present invention, will be described with reference to FIGS. 5 and 6.

Arrow C indicates the feeding direction, and the opposed crossbar carriers 20, 20 are movably mounted on the guide rails 2, 2. The description below is about one side of the transfer apparatus.

The crossbar carrier 20 is connected to a timing belt 42 fitted to pulleys 40, 41 located on both ends of the guide rail 2. A shaft 43 of the pulley 40 is coupled with a servomotor 45 through a reduction gear 44. The servomotor 45 and an encoder 47, attached to the servomotor 45, are connected to an NC controller 46 to compose drive means for driving the transfer apparatus in the feeding direction.

A support 50 is movably mounted on the crossbar carrier 20 in the feeding direction via a guide 51 and a compression spring 52. The support 50 is connected to an actuator 53, fixed to the crossbar carrier 20 and fitted with a hydraulic servo-valve 54. The crossbar 21 is attached to the support 50 and provided with an accelerometer **56*a* at the center of the top surface thereof, the accelerometer 56*a* being a sensing means for measuring the vibration in the feeding direction. An accelerometer 56*b* is also provided on the free end of the cantilever 55, which is fixed to the crossbar 21 at the center thereof with a bolt. The accelerometers 56*a*, 56*b* are connected to the controller 34 through an integrator 57. The controller 34 is connected to the hydraulic servo-valve 54 through a servo-amplifier 58. A displacement gauge 59 is provided on the crossbar carrier 20, for sensing a displacement of the actuator 53, and is connected to the hydraulic servo-amplifier 58 and the controller 34**.

Operations of the present embodiment will now be described. The servomotor 45 runs in response to a command signal from the NC controller 45. The running servomotor 45 drives the shaft 43 and the pulley 40 to pull the timing belt 42, thereby to move the crossbar carrier 20 in the feeding direction. The vibration occurring during this operational motion of the crossbar carrier 20 is sensed by the accelerometers **56*a*, 56*b* and then second-order integrated at the integrator 57 to become a displacement. Based on this displacement and a displacement of the actuator 53, together with previously obtained dynamic characteristics of the crossbar 21, and, if needed, dynamic characteristics of the actuator 53, a control input to the actuator 53 is computed in the controller 34 and outputted to the servo-amplifier 58. This causes the hydraulic servo-valve 54 to operate, thereby driving the actuator 53 in accordance with a command value, whereby the vibration of the transfer apparatus is reduced. Furthermore, the servomotor 45 is provided with the encoder 47, and data from the encoder 47 is inputted into the controller 34** as needed (for example, when timing is to be established in effecting control in an open loop). The feedback control method for reducing the vibration is not described here because it has been described in detail in the section of the first embodiment, discussing the reduction of the vibration in the vertical direction.

As for a control theory used in the controller 34 according to the present embodiment, the following control methods are used:

(1) A feedback control method which determines a gain by the LQ control theory, wherein a vibratory displacement of the cantilever 55, attached to the crossbar 21 at the center thereof, and of the crossbar 21 and a displacement of the actuator 53 are taken as reference signals, and wherein a mean square of vibratory displacements of each of the crossbar 21 and the lift bar 1 at white noise input is used as an evaluation function.

(2) A combined control method of the LMS adaptive control and the feedback control, wherein the LMS adaptive control method is used while the crossbar carrier 20 is in operational motion, and wherein the feedback control method is used while the crossbar carrier 20 is not in operational motion, the LMS adaptive control method determining a gain by the LMS algorithm with an operational motion acceleration and a displacement of the crossbar 21 taken as reference signals, and with a mean square of vibratory displacements of the crossbar 21 at an operational motion input used as an evaluation function.

(3) A combined control method of the preview learning control and the feedback control wherein the preview learning control method is used while the crossbar carrier 20 is in operational motion, and wherein the feedback control method is used while the crossbar carrier 20 is not in operational motion, the preview learning control method determining a gain by the preview learning algorithm with a displacement of the crossbar 21 taken as a reference signal and with a mean square of vibratory displacements of the crossbar 21 at an operational motion input used as an evaluation function.

(4) A feedforward control method which determines a gain by an acceleration-displacement conversion method, wherein an operational motion acceleration is taken as a reference signal, and wherein a quasi-static displacement component derived from a change in an operational motion acceleration is used as an evaluation function.

The actuators 10, 53 can be operated at any timing by the combined control method of the LMS adaptive control and the feedback control or the combined control method of the preview learning control and the feedback control.

Next, a third embodiment of the present invention will be described which uses a control theory other than those described above. According to the control theory employed by the present embodiment, an operational motion which does not generate the vibration is obtained on the basis of previously obtained dynamic characteristics of a structure system, and the difference between an operational motion created by the drive mechanism of the transfer apparatus and the previously obtained vibration-free motion is used as a control input to the actuator 53 for reducing the vibration.

Figure 5:
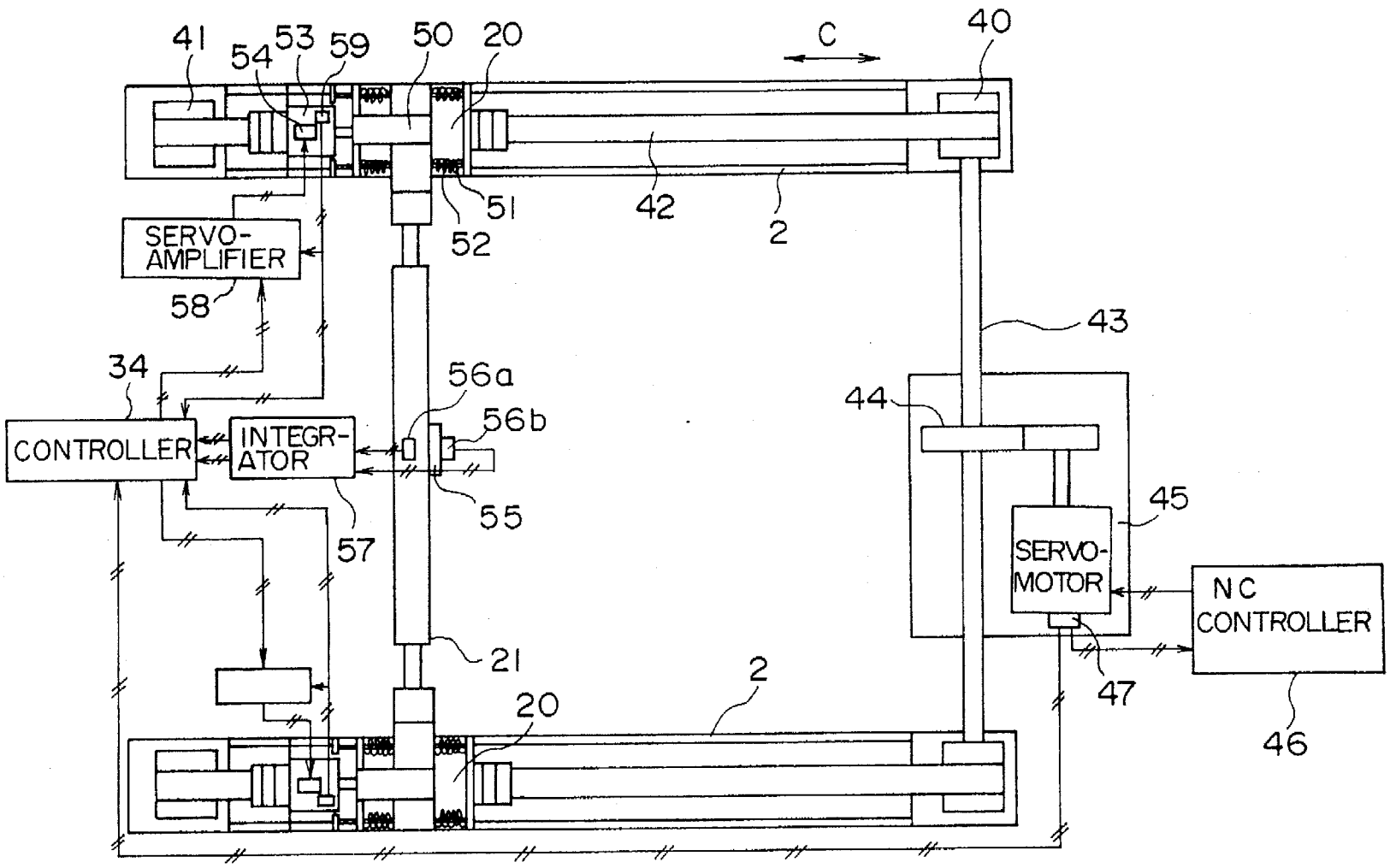
FIG. 5 is a plan view of a transfer apparatus equipped with a vibration reducer for reducing the vibration in the feeding direction according to a second embodiment of the present invention.
Figure 6:
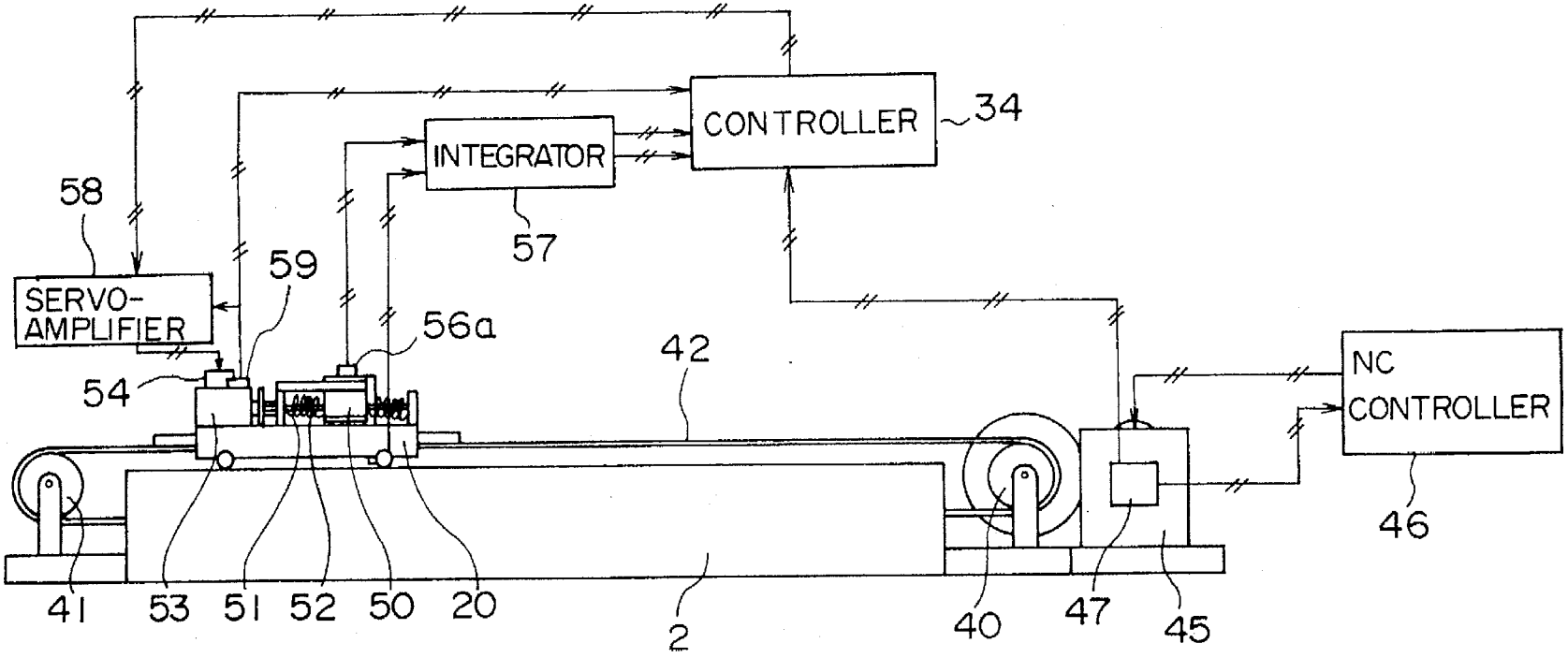
FIG. 6 is a side view of the transfer apparatus of FIG. 5.

The present embodiment is a modified version of the second embodiment which does not have the cantilever 55 attached to the crossbar 21 at the center thereof and the accelerometers 56*a*, 56*b* in FIGS. 5 and 6. The vibration-free motion is obtained by mathematical programming which uses as constraints a time duration of movement, a distance of movement, a performance of the actuator 53, and an operational motion given to the transfer apparatus on the basis of dynamic characteristics of the crossbar 21 and the actuator 53. In the present embodiment, a damping path is obtained, particularly to suppress the residual vibration.

Next, the damping effect of the vibration reducer will be described for the first, second, and third embodiments with reference to FIGS. 7 to 14*c*.

Figure 7:
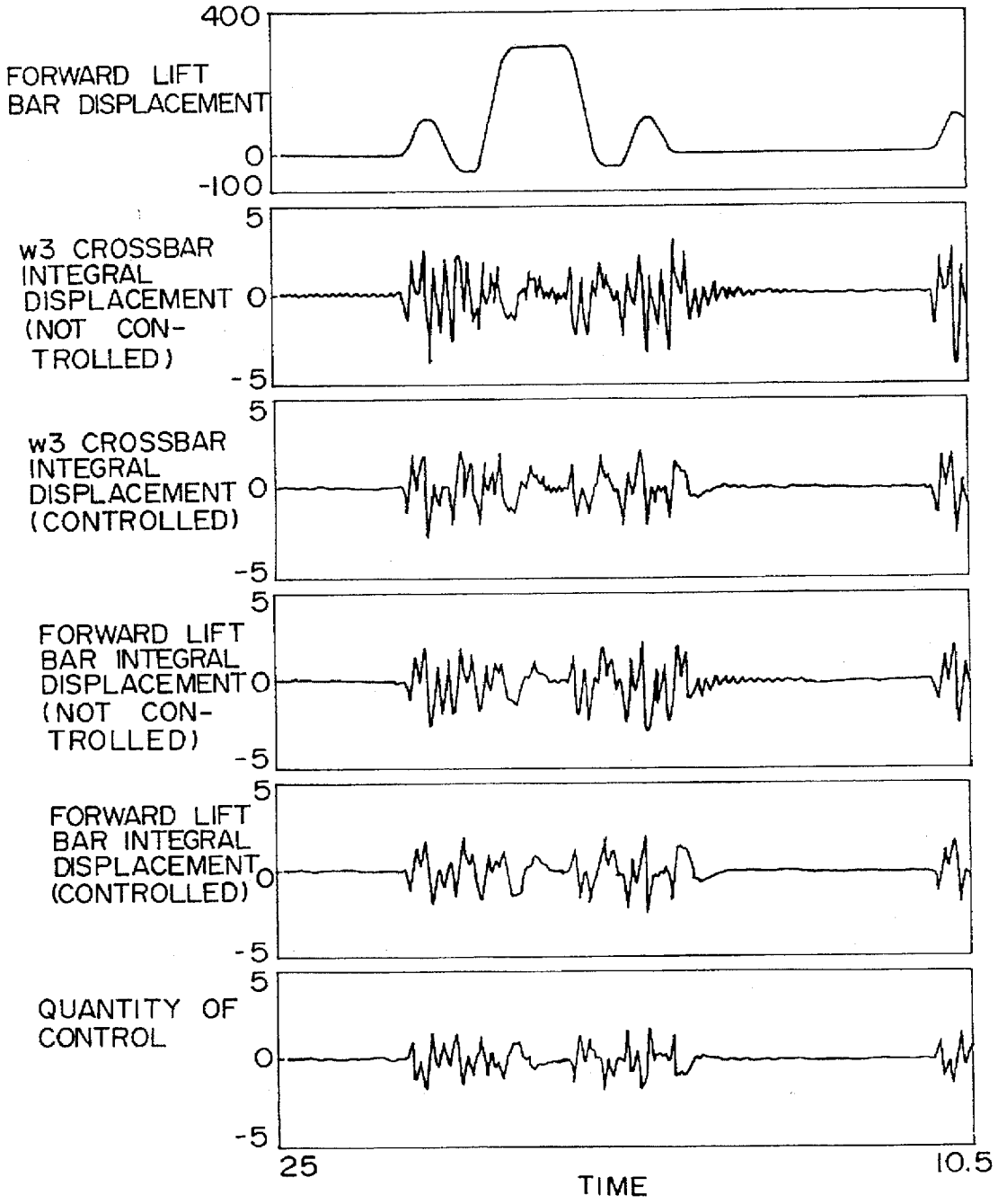
FIG. 7 is a collection of graphs illustrating the damping effect of a feedback control according to the first embodiment on the vibration in the vertical direction of a lift bar-actuator vibration system.

FIG. 7 is a collection of graphs of the first embodiment showing how the vibration in the vertical direction is reduced by the feedback control which uses as quantities of state a displacement obtained by integrating an acceleration of the lift bar 1 and a displacement of the actuator 10. The graphs of FIG. 7 show, from top to bottom, a displacement of the lift bar 1 (operational motion path), the vibration of the crossbar 21 when control is not effected, the vibration of the crossbar 21 when control is effected, the vibration of the lift bar 1 when control is not effected, the vibration of the lift bar 1 when control is effected, and waveform of a control command signal (quantity of control). As seen from FIG. 7, the residual vibration is completely suppressed, and the vibration during an operational motion is reduced by about 40 percent.

Figure 8:
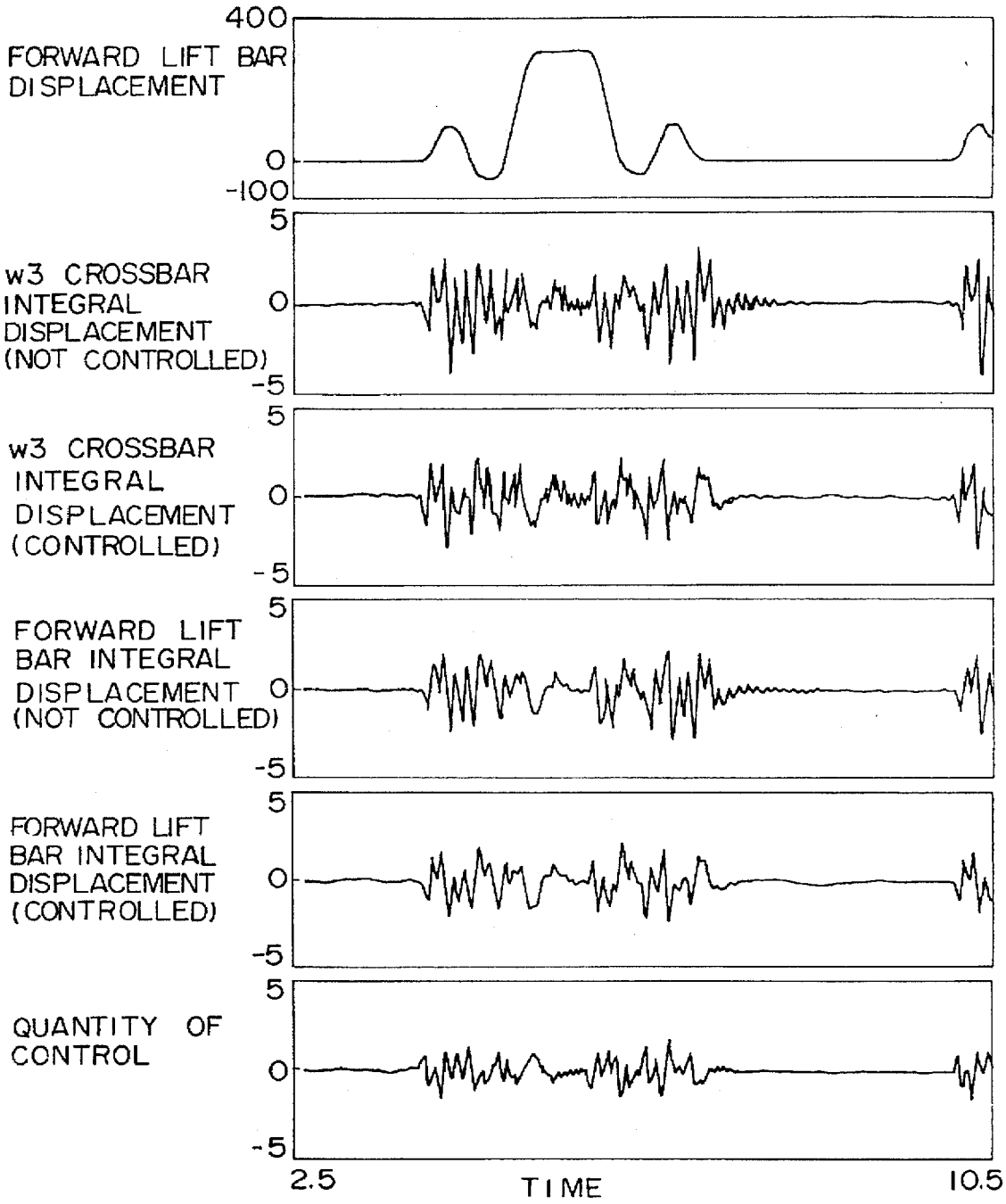
FIG. 8 is a collection of graphs illustrating the damping effect of the feedback control according to the first embodiment on the vibration in the vertical direction of a crossbar-lift bar-actuator system.

FIG. 8 is a collection of graphs showing the case of FIG. 7 to which a displacement obtained by integrating an acceleration of the crossbar 21 is added as an additional quantity of state. As seen from FIG. 8, the residual vibration is well suppressed, and the vibration during an operational motion is reduced by about 30 percent.

Figure 9:
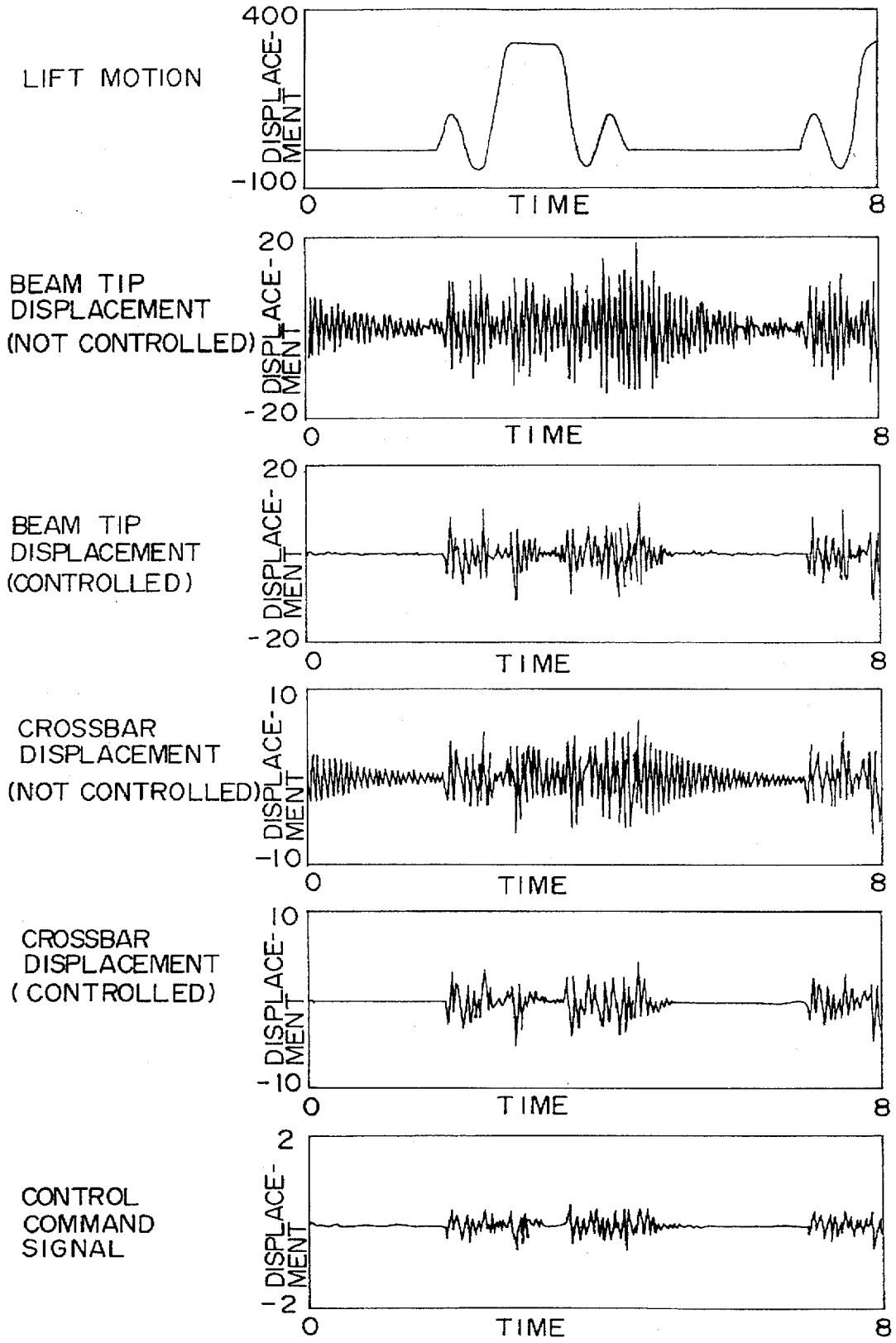
FIG. 9 is a collection of graphs illustrating the damping effect of a feedback control according to a second embodiment of the present invention on the vibration in the feeding direction.
Figure 10:
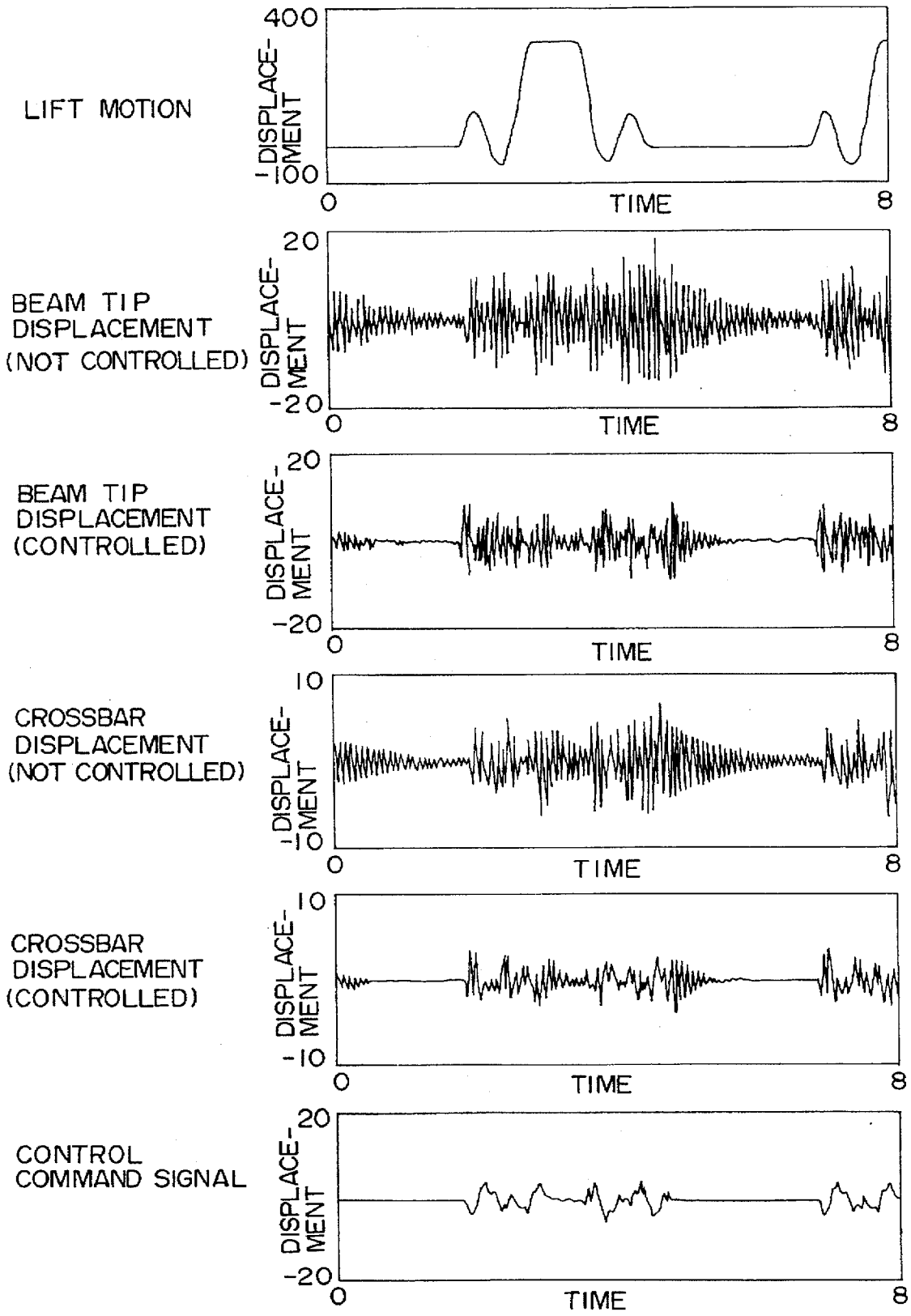
FIG. 10 is a collection of graphs illustrating the damping effect of a combined control of LMS adaptive control and feedback control according to the second embodiment on the vibration in the feeding direction.
Figure 11:
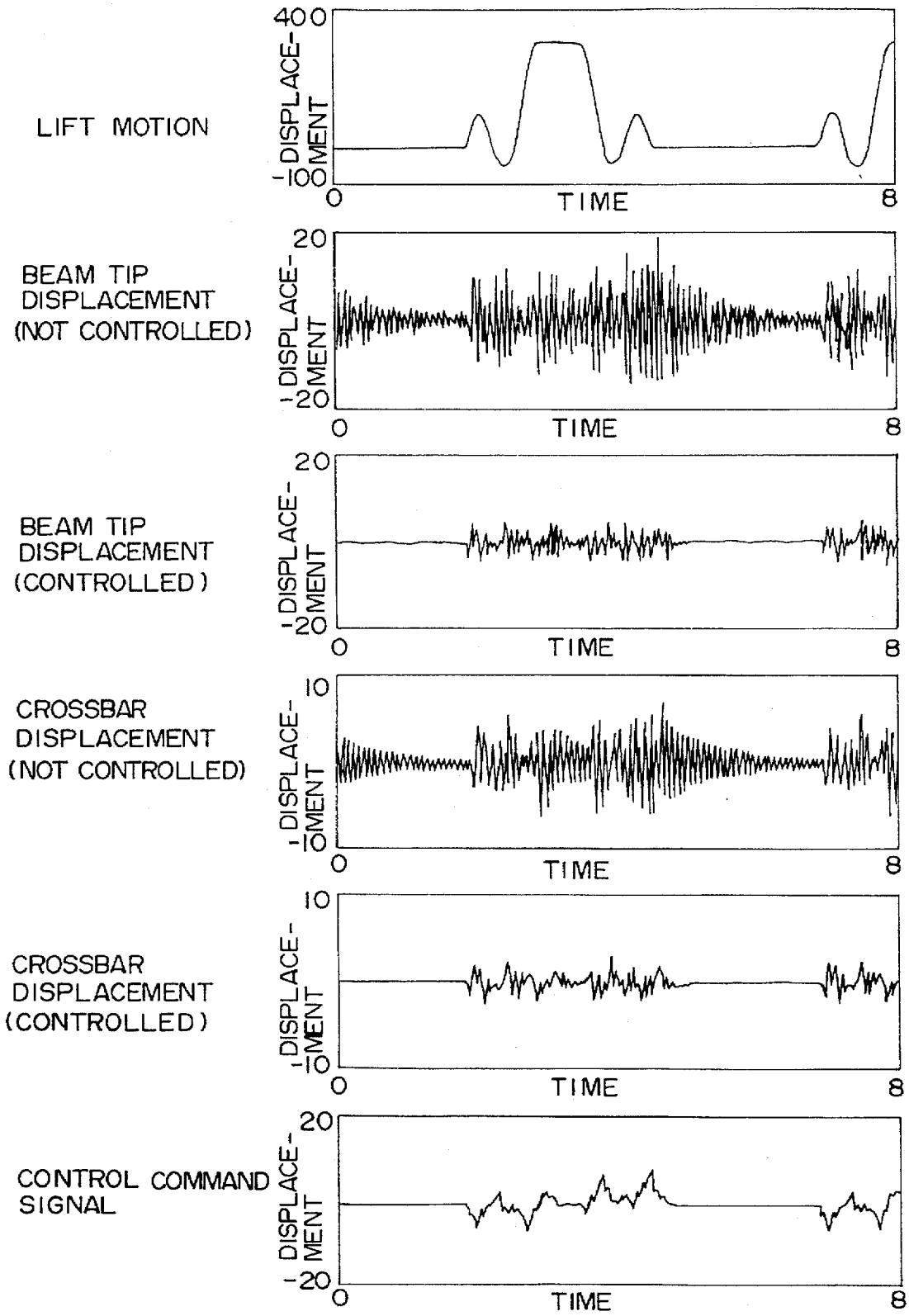
FIG. 11 is a collection of graphs illustrating the damping effect of a combined control of preview learning control and feedback control according to the second embodiment on the vibration in the feeding direction.
Figure 12:
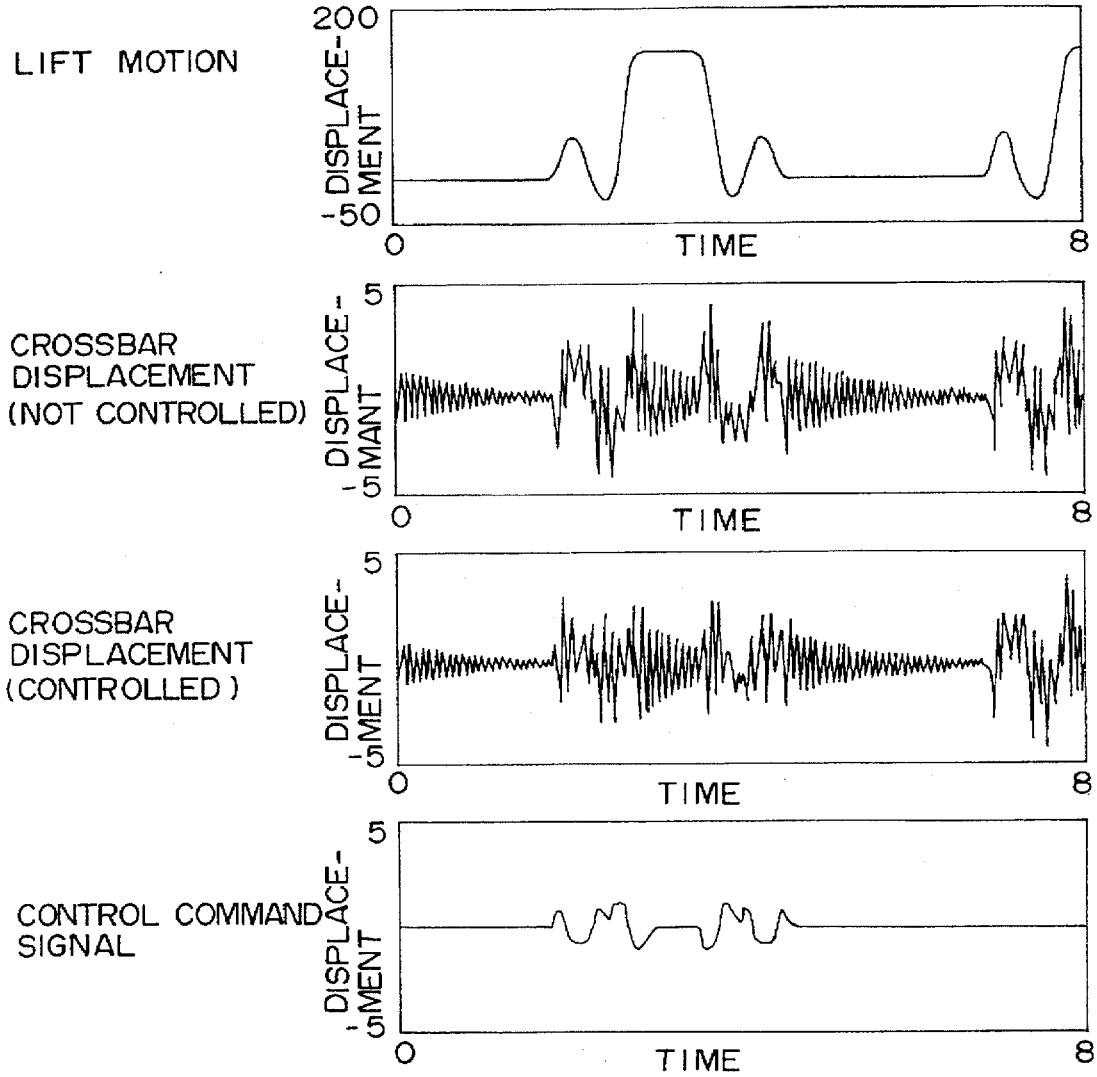
FIG. 12 is a collection of graphs illustrating the damping effect of a feedforward control according to the second embodiment on the vibration in the feeding direction.

FIGS. 9 to 12 are graphs of the second embodiment showing how the vibration in the feeding direction is reduced. FIG. 9 shows the case of the feedback control. FIG. 10 shows the case of a combined control of the LMS adaptive control and the feedback control (the LMS adaptive control is effected when an operational motion is given, and the feedback control is effected when an operational motion is not given). FIG. 11 shows the case of a combined control of the preview learning control and the feedback control (the preview learning control is effected when an operational motion is given, and the feedback control is effective when an operational motion is not given). FIG. 12 shows the case of the feedforward control. The graphs of each of FIGS. 9 to 11 show, from top to bottom, a given operational motion, the vibration of the cantilever 55 when control is not effected, the vibration or the cantilever 55 when control is effected, the vibration of the crossbar 21 when control is not effected, the vibration of the crossbar 21 when control is effected, and the waveform of a control command signal. The graphs of FIG. 12 show, from top to bottom, a given operational motion, the vibration of the crossbar 21 when control is not effected, the vibration of the crossbar 21 when control is effected, and the waveform of a control command signal.

In the case of using the feedback control of FIG. 9, the residual vibration is completely removed at a very small quantity of control, and the vibration during an operational motion is reduced by about 40 percent. In the case of using a combined control of the LMS adaptive control and the feedback control of FIG. 10, there remains some residual vibration due to the changeover of the control methods, but the vibration of the cantilever 55 during an operational motion is reduced by about 60 percent in terms of a peak level. In the case of using a combined control of the preview learning control and the feedback control of FIG. 11, an influence of changing over the control methods is not much observed, the residual vibration is well suppressed, and the vibration of the cantilever 55 during an operational motion is reduced by about 70 percent. In the case of using the feedforward control of FIG. 12, an effect of reducing the residual vibration is not much observed, but a peak level during an operational motion is reduced. This is because the feedforward control is expected to reduce a quasi-static component derived from an operational motion acceleration.

Figure 13A:
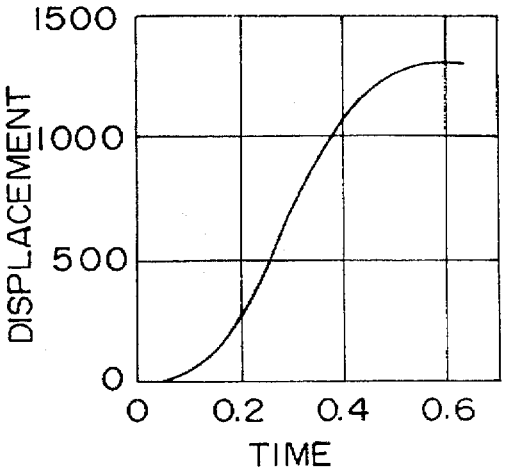
FIGS. 13*a* to 13*d* are graphs illustrating the relationship between a motion displacement and a velocity in a control method according to a third embodiment of the present invention in which a control input is obtained from a damping motion.
Figure 13B:
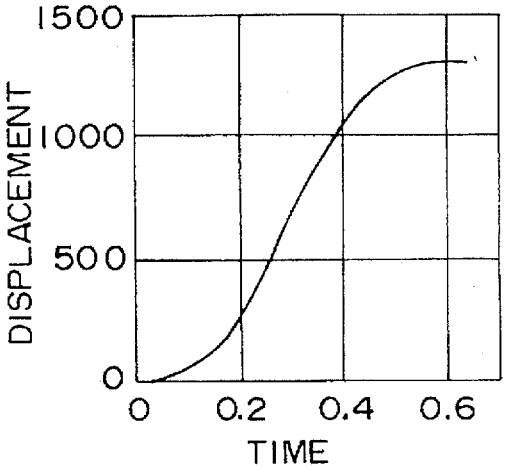
Figure 13C:
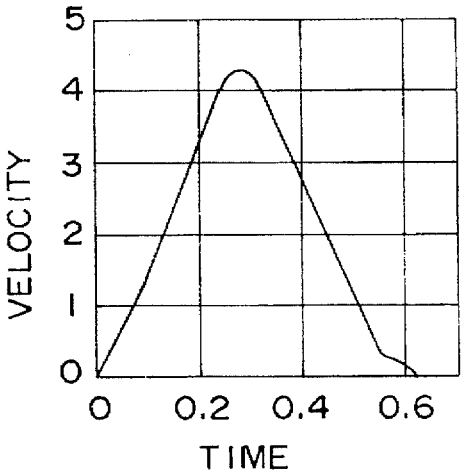
Figure 13D:
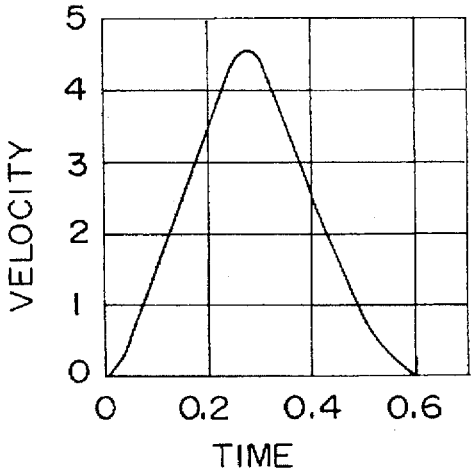
Figure 14A:
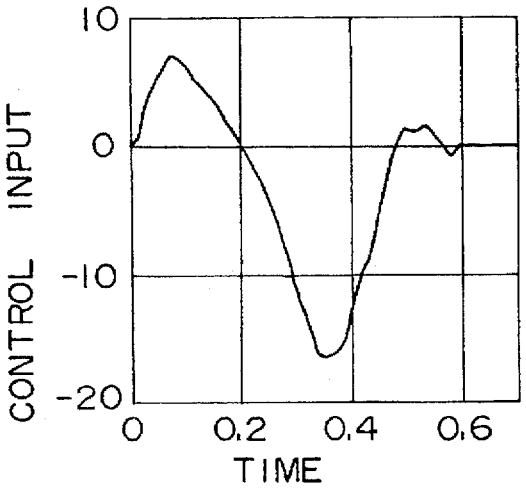
FIGS. 14*a* to 14*c* are graphs illustrating the damping effect of the control method according to the third embodiment on the residual vibration.
Figure 14B:
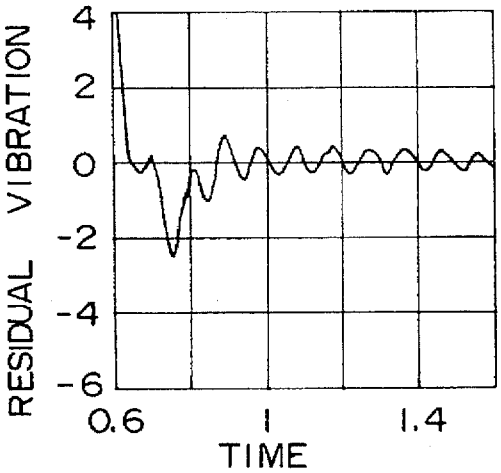
Figure 14C:
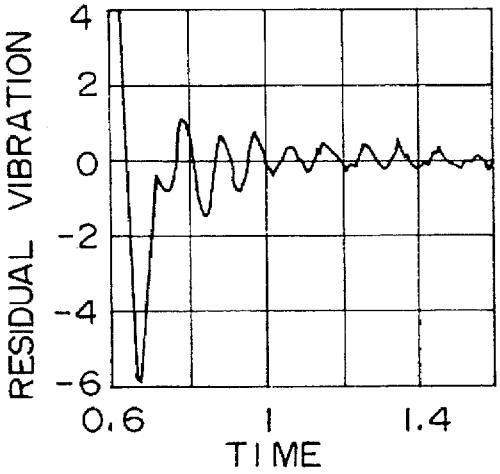

Next, a damping effect of the third embodiment in which a control input is obtained from a damping motion will be described. FIG. 13*a* shows a motion displacement obtained in the present embodiment. FIG. 13*b* shows a motion displacement along a trapecloid path. FIG. 13*c* shows a motion velocity obtained in the present embodiment. FIG. 13*d* shows a velocity of movement along the trapecloid path. A distance of movement used is 1300 mm, and a time duration of movement used is 0.64 sec. FIG. 14*a* shows a control input to the actuator 53 in the present embodiment. FIG. 14*b* shows the residual vibration when an operational motion is effected along a path obtained in the present embodiment. FIG. 14*c* shows the residual vibration when an operational motion is effected along the trapecloid path. As seen from FIGS. 14*a* to 14*c*, the intensity of the first wave of the residual vibration in the present embodiment is reduced to one-third of that at movement along the trapecloid path.

INDUSTRIAL APPLICABILITY

The present invention is effective to serve as a vibration reducer for a transfer apparatus in a transfer press and the like capable of effectively and easily reducing not only the residual vibration after halting an operational motion of a workpiece transfer apparatus but the vibration during an operational motion thereof.

What is claimed is:

1. A workpiece transfer apparatus comprising:

a workpiece holding mechanism;

a support member for supporting said workpiece holding mechanism;

a positioning unit for movably positioning said support member;

a drive unit to effect movement of said support member;

a motion transmission mechanism extending from said drive unit to said support member;

a controllable actuator provided in said motion transmission mechanism;

at least one sensing means provided on at least one of said workpiece holding mechanism, said support member, said positioning unit, and said drive unit; and a controller for receiving measurement signals from said at least one sensing means, said controller being adapted to determine a damping motion control input signal on the basis of said measurement signals from said at least one sensing means, and to apply said damping motion control input signal to said actuator to operate said actuator so that vibration of the transfer apparatus is reduced.

2. A workpiece transfer apparatus in accordance with claim 1, wherein said controller is adapted to store previously obtained dynamic characteristics of said support member, and determines said damping motion control input signal on the basis of said measurement signals from said at least one sensing means and the thus stored previously obtained dynamic characteristics of said support member.

3. A workpiece transfer apparatus in accordance with claim 1, wherein said controller is adapted to store previously obtained dynamic characteristics of said actuator, and determines said damping motion control input signal on the basis of said measurement signals from said at least one sensing means and the thus stored previously obtained dynamic characteristics of said actuator.

4. A workpiece transfer apparatus in accordance with claim 1, wherein said controller is adapted to store previously obtained dynamic characteristics of said support member and previously obtained dynamic characteristics of said actuator, and determines said damping motion control input signal on the basis of said measurement signals from said at least one sensing means, the thus stored previously obtained dynamic characteristics of said support member, and the thus stored previously obtained dynamic characteristics of said actuator.

5. A workpiece transfer apparatus in accordance with claim 1, wherein said controller is adapted to apply said damping motion control input signal to said actuator to operate said actuator each time said damping motion control input signal is determined.

6. A workpiece transfer apparatus in accordance with claim 1, wherein said controller is adapted to apply said damping motion control input signal to said actuator to operate said actuator at an arbitrary timing.

7. A workpiece transfer apparatus in accordance with claim 1, wherein said at least one sensing means comprises an accelerometer provided on said support member, and an integrator connected between said accelerómeter and said controller.

8. A workpiece transfer apparatus in accordance with claim 1, wherein said at least one sensing means comprises an accelerometer provided on said support member and an integrator connected between said accelerometer and said controller, and a displacement gauge positioned on said actuator.

9. A workpiece transfer apparatus in accordance with claim 1, wherein said workpiece holding mechanism includes at least one vacuum cup for vacuum chucking a workpiece; and wherein said support member comprises at least one element for supporting said at least one vacuum cup.

10. A workpiece transfer apparatus in accordance with claim 9, having a feeding direction in which the workpiece is transferred, wherein said motion transmission mechanism includes at least one lift bar extending parallel to said feeding direction and at least one lift box for raising and lowering said at least one lift bar, wherein each said element is a crossbar, wherein said positioning unit comprises at least one crossbar carrier supporting each said crossbar, each said at least one crossbar carrier being positioned on one of said at least one lift bar so as to permit movement of said at least one crossbar carrier along said at least one lift bar in a direction parallel to said feeding direction.

11. A workpiece transfer apparatus in accordance with claim 10, wherein said at least one sensing means comprises an accelerometer provided on a crossbar, and an integrator connected between said accelerometer and said controller.

12. A workpiece transfer apparatus in accordance with claim 10, wherein said at least one sensing means comprises an accelerometer provided on one of said at least one lift bar, and an integrator connected between said accelerometer and said controller.

13. A workpiece transfer apparatus in accordance with claim 10, wherein said motion transmission mechanism includes a drive rod connected between said drive unit and said at least one lift box, and wherein said actuator is connected to said drive rod so as to vary the position of said drive rod and thereby vary the vertical position of said at least one lift bar.

14. A workpiece transfer apparatus in accordance with claim 13, further comprising means for moving said at least one crossbar carrier along said at least one lift bar in a direction parallel to said feeding direction.

15. A workpiece transfer apparatus in accordance with claim 13, Wherein said drive unit comprises a cam shaft, a lift cam, and a lift lever, and wherein said drive rod is positioned by said lift lever and said actuator.

16. A workpiece transfer apparatus comprising:

a workpiece holding mechanism;

a support member for supporting said workpiece holding mechanism;

a positioning unit for movably positioning said support member;

a drive unit to effect movement of said support member;

a motion transmission mechanism extending from said drive unit to said support member;

a controllable actuator provided in said motion transmission mechanism;

sensing means provided on at least one of said workpiece holding mechanism, said support member, said positioning unit, and said drive unit; and a controller for receiving measurement signals from said sensing means, said controller being adapted to determine a damping motion control input signal on the basis of said measurement signals from said sensing means and at least one of previously obtained dynamic characteristics of said support member and of previously obtained dynamic characteristics of said actuator, and to apply said damping motion control input signal to said actuator to operate said actuator so that vibration of the workpiece transfer apparatus is reduced.

17. A workpiece transfer apparatus in accordance with claim 16, wherein said controller is adapted to apply said damping motion control input signal to said actuator to operate said actuator at an arbitrary timing.

18. A workpiece transfer apparatus in accordance with claim 16, wherein said controller determines, moment by moment, the damping motion control input signal on the basis of said measurement signals from said sensing means, said previously obtained dynamic characteristics of said support member, and said previously obtained dynamic characteristics of said actuator, and operates said actuator each time said damping motion control input signal is determined.

19. A workpiece transfer apparatus comprising:

a workpiece holding mechanism;

a support member for supporting said workpiece holding mechanism;

a positioning unit for movably positioning said support member;

a drive unit to effect movement of said support member;

a motion transmission mechanism extending from said drive unit to said support member;

a controllable actuator provided in said motion transmission mechanism; and a controller adapted to determine a damping motion on the basis of previously obtained dynamic characteristics of said support member and previously obtained dynamic characteristics of said actuator, to determine a damping motion control input signal responsive to a difference between a motion made by said drive unit and a thus determined damping motion, and to apply said damping motion control input signal to said actuator to operate said actuator so that vibration of the workpiece transfer apparatus is reduced.

20. A workpiece transfer apparatus in accordance with claim 19, wherein said controller is adapted to apply said damping motion control input signal to said actuator to operate said actuator at an arbitrary timing.

* * * * *